United States Patent [19]

Whitmore et al.

[11] 3,964,844

[45] June 22, 1976

[54] VANE PUMP

[75] Inventors: Charles H. Whitmore, Plainwell; Paul K. Houtman, Kalamazoo; Elwyn E. Engelter, Otsego, all of Mich.

[73] Assignee: Parker-Hannifin Corporation, Cleveland, Ohio

[22] Filed: Sept. 24, 1973

[21] Appl. No.: 399,854

[52] U.S. Cl. ..... 418/133; 418/81

[51] Int. Cl.[2] ..... F04C 15/00

[58] Field of Search ..... 418/80, 81, 131, 133, 418/135, 132

[56] References Cited

UNITED STATES PATENTS

| | | | |
|---|---|---|---|
| 2,977,891 | 4/1961 | Bishop | 91/494 X |
| 3,479,962 | 11/1969 | Pettibone | 418/133 |
| 3,645,654 | 2/1972 | Niemiec et al. | 418/133 |
| 3,664,776 | 5/1972 | Mills et al. | 418/133 X |
| 3,695,789 | 10/1972 | Jansson | 418/133 X |

*Primary Examiner*—C. J. Husar
*Assistant Examiner*—Leonard Smith
*Attorney, Agent, or Firm*—Donnelly, Maky, Renner & Otto

[57] ABSTRACT

A vane pump in which the clearance between the side plates and the rotor and the cam ring is maintained as a substantially constant dimension by hydrostatic means regardless of dimensional changes of the pump parts due to thermal conditions when the pump is operating. At least one of the side plates is flexible so that it can flex to maintain its proper clearance with both the cam ring and rotor despite variations in the thickness of the cam ring and rotor that may occur during manufacture of these parts and/or due to temperature differentials within the pump during operation.

24 Claims, 12 Drawing Figures

VANE PUMP

BACKGROUND OF THE INVENTION

In hydraulic pumps there is an ever present objective for improving volumetric and overall efficiency. This objective has been accentuated in recent times by the need to consume energy. In the past, it has not been practical to obtain overall efficiencies of more than 75% for high pressure vane type pumps but now with the need to consume energy higher efficiencies are greatly desired.

In hydraulic pumps, the volumetric efficiency is the percentage of fluid by volume that is discharged through the outlet port as compared with the volume coming into the suction side of the pumping chamber. Some of the fluid leaks from the pump pressure cavity through various leakage paths between the pump parts and does not reach the outlet port. This leakage fluid is referred to as hydraulic slip and the leakage fluid is recovered either by re-pumping it back to the pressure cavity or by draining it from the pump housing to a reservoir. The greater the slip the less the volumetric efficiency and consequently a lower overall efficiency for the pump.

In vane pumps a large part of the slip is through the necessary clearances that must be established between the side surfaces of the rotor and the adjacent flat faces of the side plates. In the case of variable vane pumps, there must also be clearances between the sides of the cam ring and the adjacent flat surfaces of the housing or side plates. It is necessary to have clearances at the locations referred to in order that the rotor may rotate freely without binding and in order that the cam ring may be moved freely without sticking or binding for varying the volume of the pump. A practical clearance in these locations for avoiding binding or sticking of the rotor and cam ring may be, for example, about 0.0004 inch in a pump for delivering 65 gallons per minute at 2,500 psi.

Such a clearance of about 0.0004 inch has been not only difficult to obtain initially because of manufacturing variations in the parts, but also as been materially affected by temperature differentials created within the pump during operation. Thus, for example, differential expansion of the rotor relative to the spacer due to temperature conditions may be as much as 0.0008 inch or more. To accommodate this differential expansion the total clearance on the two sides of the rotor must be increased by 0.0008 inch so that when the parts change dimension in a manner to decrease the clearances because of thermal conditions during operation, the initial clearance on each side must be 0.0008 inch instead of the desired 0.0004 inch. The importance of maintaining a very small clearance during operation of the pump is accented when it is realized that at a pump operation pressure of 2,500 psi the leakage or slip is more than 8 times greater through a 0.0008 inch clearance than through a 0.0004 inch clearance. If the rotor does not remain centered so that all of the additional 0.0008 inch clearance occurs at one side, the slip becomes 14 times greater.

SUMMARY OF THE INVENTION

This invention provides a hydrostatic means for automatically maintaining a substantially constant clearance between the side plates of a vane pump and the adjacent surfaces of the pump rotor and cam ring despite dimensional variations occurring during manufacturing and dimensional changes occurring in the pump parts due to thermal conditions while the pump is operating. This is accomplished by pressure loading of the plates in combination with hydrostatic bearing pockets on the inner sides of the plates next to the rotor and cam ring that are connected to the pump high pressure chamber by restricted passages.

One of the plates may be rigid and in a fixed stationary position against a wall of the pump housing while the other plate is flexible and is floatingly mounted between another wall of the housing and the rotor and cam ring. This floating plate has pressure areas on its outer side face opposite both the rotor and cam ring and which are exposed to full pump discharge pressure for biasing the floating plate toward the rotor and cam ring. When the portion of the floating plate that is opposite the rotor has established its proper clearance therewith the plate may flex so that the portion opposite the cam ring may establish its proper clearance therewith even though the side faces of the rotor and cam ring are not in the same plane due to dimensional variations occurring during manufacture of these parts or due to thermally induced differential expansion of the parts during operation of the pump.

DETAILED DESCRIPTION OF THE DRAWINGS

Figure 1:
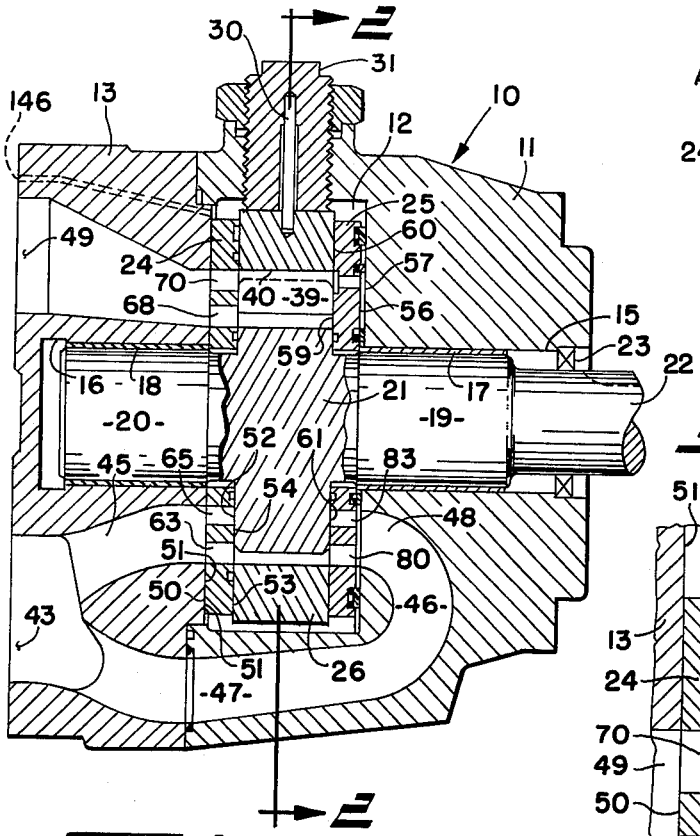
FIG. 1 is a vertical cross-section through a variable volume vane type pump.

Except for the configuration of the side plates, the vane pump 10 illustrated herein is of conventional construction and includes a housing 11 having a chamber 12 that is closed by a cap 13 bolted or otherwise attached to housing 11. Housing 11 and cap 13 have aligned bores 15 and 16 to receive bearing bushings 17, 18 that support shafts 19, 20 that are integral with a rotor 21. Shaft 19 has a reduced portion 22 that extends outside of housing 11 for driving the rotor and is sealed by a sealing ring 23.

Rotor 21 is positioned between a stationary side plate 24 and a floating side plate 25, all within chamber 12.

Cam ring 26 encircles rotor 21 and is also positioned between plates 24, 25. The cam ring is movable by hydraulic pistons 28, 29 for varying the displacement of the pump. A pin 30 in plug 31 enters a recess in the cam ring 26 to prevent rotation of the latter. The outer end of piston 28 is constantly exposed to pump discharge pressure which is fed into cylinder 32 by a duct 33 that connects with the discharge side of the pump. Piston 29 is biased by spring 34 against cam ring 26 and pressure is introduced into the cylinder behind piston 29 from the discharge side of the pump through ducts 35 and 36 and is controlled by a servo valve 37 in a conventional manner, as for example as disclosed in U.S. Pat. No. 3,549,281.

Rotor 21 has a series of radial slots 38 therein in which vanes 39 are slidably mounted. As is well known, centrifugal force and hydraulic pressure differential acting on the inner ends of the vanes 39 forces the latter radially outwardly against the inner wall 40 of cam ring 26 as the rotor 21 turns to create the pumping action.

Cap 13 provides an inlet port 43 having pairs of branches 44, 45. There is also an inlet passage 46 in body 11, having branches 47 in alignment with branches 44 and having branches 48 in alignment with branches 45. Branches 45 and 48 intersect chamber 12 at the suction side of the pumping chamber Cap 13 also has a outlet port 49 that intersects chamber 12 and from which fluid under high pressure is discharged from the pump.

Figures 3, 4:
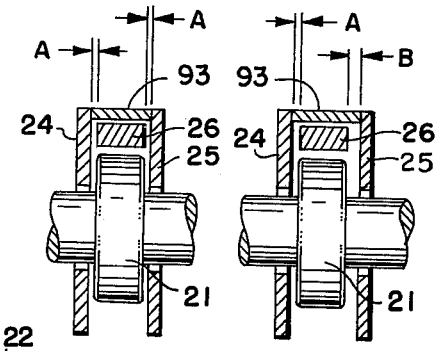
FIG. 3 is a fragmentary view showing ideal clearances between the pump rotor and side plates in exaggerated fashion.
FIG. 4 is a view like FIG. 3 showing how at least one of the clearances can increase due to temperature differentials in the pump parts during operation.

Stationary side plate 24 has an outer face 50 in abutting engagement with a flat face 51 on cap 13 and has an inner face 52 adjacent side face 53 of cam ring 26 and side face 54 of rotor 21. Similarly, floating plate 25 has an outer face 56 adjacent a flat face 57 in housing 11 and an inner face 59 adjacent side faces 60 of cam ring 26 and 61 of rotor 21. Stationary plate 24 is further illustrated in FIGS. 6, 7 and 8 while floating plate 25 is further illustrated in FIGS. 3, 10 and 11.

Figure 5:
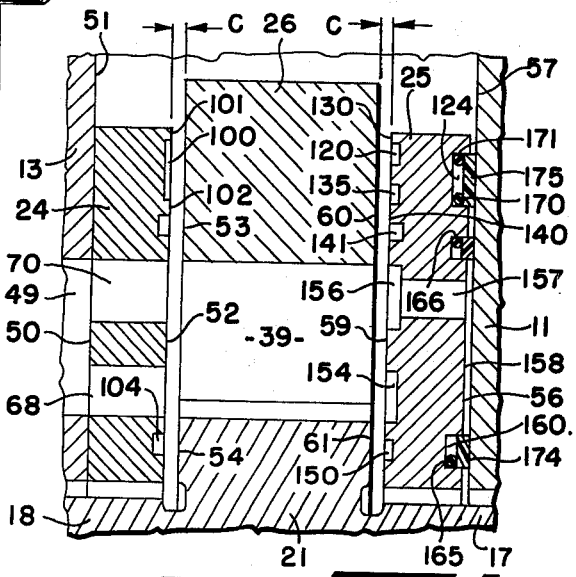
FIG. 5 is a fragmentary section view showing the relation of the pressure cavities in the side plates with respect to the rotor and cam ring and with the clearance therebetween exaggerated.
Figure 2:
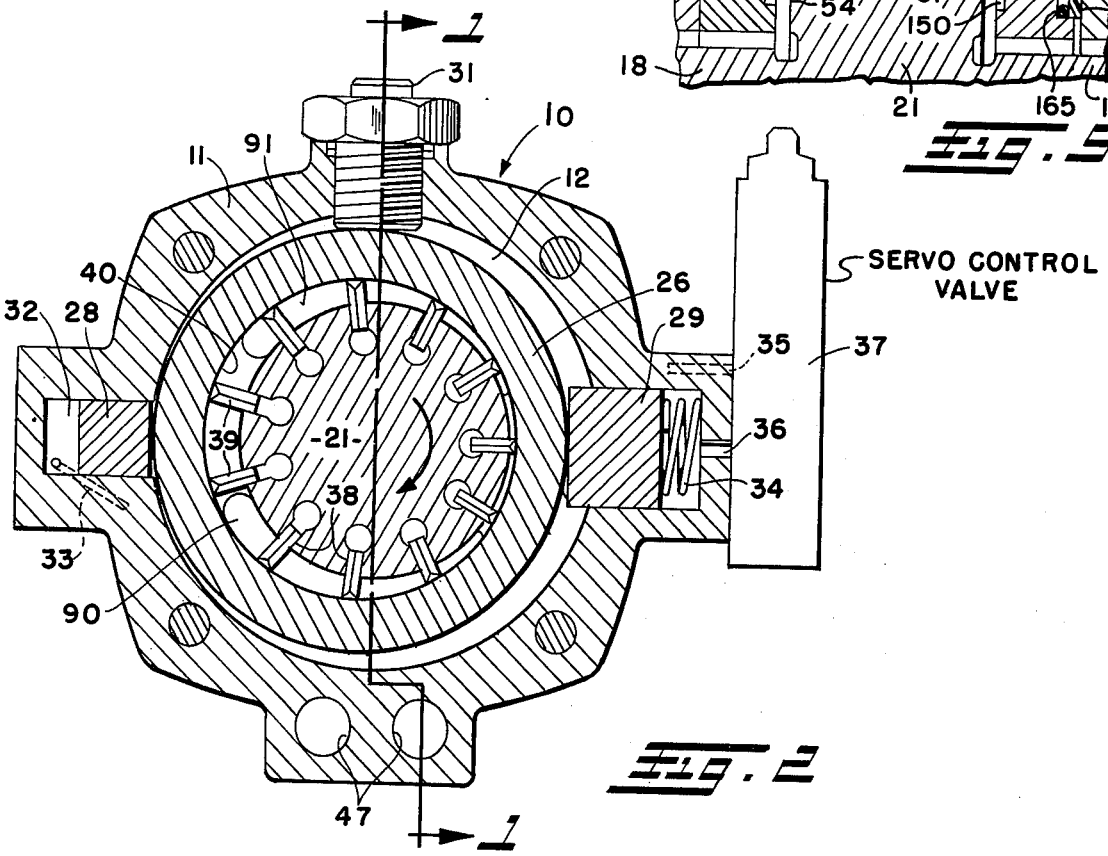
FIG. 2 is a section through lines 2—2 of FIG. 1.

As hereinafter explained, the inner faces 52 and 59 of the respective plates 24 and 25 constitute bearing surfaces for the opposite side faces 53 and 60 of the cam ring 26 and for the opposite side faces 54 and 61 of the rotor 21 to maintain a predetermined minute clearances C (FIG. 5).

Stationary plate 24 has the usual inlet openings 62, 63, 64 and 65 that are aligned with inlet passages 45 and also has discharge openings 67, 68, 69 and 70 therethrough that are aligned with the inner end of outlet port 49. Plate 24 may be pinned to cap 13 by two or more pins 72. Openings 62, 63 are connected by a groove 73, openings 64, 65 are connected by a groove 74, openings 67, 68 are connected by a groove 75, and openings 69, 70 are connected by a groove 76.

Likewise, floating plate 25 has a pair of inlet openings 80, 81 therethrough connected by a groove 82 and openings 83, 84 connected by a groove 85. Such openings are in register with pump inlet branches 48. Pins 88 fit into openings of plate 25 and are fixed to housing 11 to prevent rotation of plate 25.

In the pump as thus far described, cam ring 26 is initially biased to its full eccentric position about rotor 21 by spring 34 acting through piston 29. Upon rotation of the rotor 21 by means of shaft 22, fluid will be drawn into pump inlet chamber 90 and into the bottom portion of vane slots 38 from inlet passages 45, 48 through openings 62, 63, 64 and 65 of stationary plate 24 and through openings 80, 81, 83 and 84 of floating plate 25 and will then be carried to the high pressure chamber 91 of the pump by the vanes 39 for pressurizing the fluid and will be discharged from this chamber and the spaces at the bottom of the vanes 39 under high pressure through openings 67, 68, 69 and 70 of plate 24 into outlet port 49. When outlet pressure reaches a predetermined value, the servo control valve 37 will be actuated to bleed pressure fluid from behind piston 29 to permit piston 28 to move cam ring 26 toward a position for decreasing the volumetric output, and hence the outlet pressure.

The construction of the pump 10 and of its operation as thus far described is known in the art. The improvement afforded by the present invention will now be described.

It is evident that plates 24, 25 should not bear directly upon either of the side surfaces of the rotor 21 because this would result in undue friction with consequent overheating and binding of the parts. Likewise, the plates 24 and 25 should not bear directly against the side surfaces of cam ring 26 because the resulting friction therewith would not permit ready movement of the cam ring 26 for sensitive control of its eccentricity by pistons 28, 29 and servo valve 37. This then requires that there be a clearance at all times between the plates 24, 25 and the rotor 21 and cam ring 26. However, such clearances result in leakage or slip of high pressure fluid from high pressure chamber 91 to locations within the pump other than outlet port 49. Slip fluid may be directed back to the pump inlet chamber 90 from which it is repumped to the pressure chamber 91, or it may be drained from the pump housing 11 to a reservoir through a drain passage 146.

The clearances at the sides of the rotor 21 and cam ring 26 through which a large portion of the hydraulic slip occurs are essentially flow paths of rectangular cross-section for which the equation for laminar flow therethrough is:

$$Q = \frac{\Delta P\, W\, h^3}{6.69 \times 10^{-6}\, S\, V\, L}$$

$Q$ = Flow — GPM
$\Delta P$ = Pressure Loss — psi
$W$ = Width of Passage (perpendicular to flow) — Inch
$h$ = Height of Passage — Inch
$S$ = Specific Gravity
$V$ = Viscosity — Centistokes
$L$ = Length of Passage (parallel to flow) — Inch From this equation it is noted that the leakage flow varies with the cube of the passage depth, which in the case of the flow paths between the side plates 24, 25 and the rotor 21 and cam ring 26 is the width of the clearances therebetween. Thus, from the equation it will be seen that a small increase in the clearance will cause a large increase in the hydraulic slip. In order to maintain the efficiency of the pump 10 to a reasonable level, these clearances must be quite small, as for example, in a pump of 65 gallons per minute capacity at 2,500 psi, an ideal clearance would be 0.0004 inch, (see FIG. 3 in which a spacer ring 93 in accordance with prior practice is illustrated for establishing initial predetermined clearances A between the side plates and the rotor 21 and cam ring 26). However, operation of the pump can develop temperature differentials between the rotor 21 and spacer ring 93 which in a typical known pump may be as much as 75°F. which, with the steel and cast iron materials normally used for the pump parts can result in an expansion of the rotor 21 axial width by as much as 0.0008 inch relative to the axial width of the spacer ring plate. Thus, if the width of clearance A is initially 0.0004 inch, an additional 0.0008 inch must be added to one of these clearances, as at B (FIG. 4), to accommodate this differential expansion. This results in a clearance at B of 0.0012 inch if all the increase occurs on one side of the rotor 21. According to the above formula, this would result in a leakage increase through this particular clearance so that the increased leakage through the 0.0012 inch clearance is 27 times that of the leakage through the original 0.0004 inch clearance. In this case, the total leakage through the two clearances has then increased 14 times with a consequent material reduction in the pump efficiency. If the rotor remains centered so that the clearances each become 0.0008 inch, the total leakage will increase eight times, which is still a large increase.

Because of the conditions just described, it is very difficult to obtain overall efficiencies in 2500 psi variable volume vane pumps greater tha 75%. This overall efficiency has been acceptable in the past when abundant energy was available, but because of present needs for conserving energy, higher vane pump efficiencies are highly desirable. The present invention provides a means for obtaining overall efficiencies of about 90%.

Figure 6:
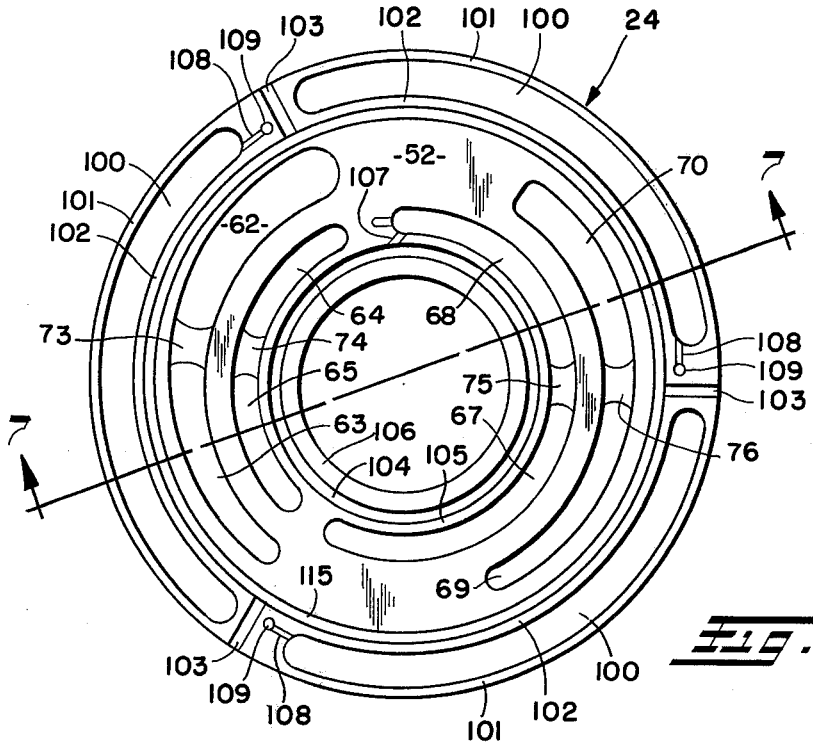
FIG. 6 is a view of the side of the rigid or non-floating plate that fits against the rotor and cam ring.
Figure 7:
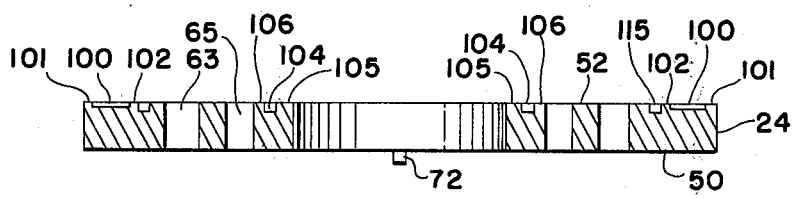
FIG. 7 is a section through lines 7—7 of FIG. 6.
Figure 8:
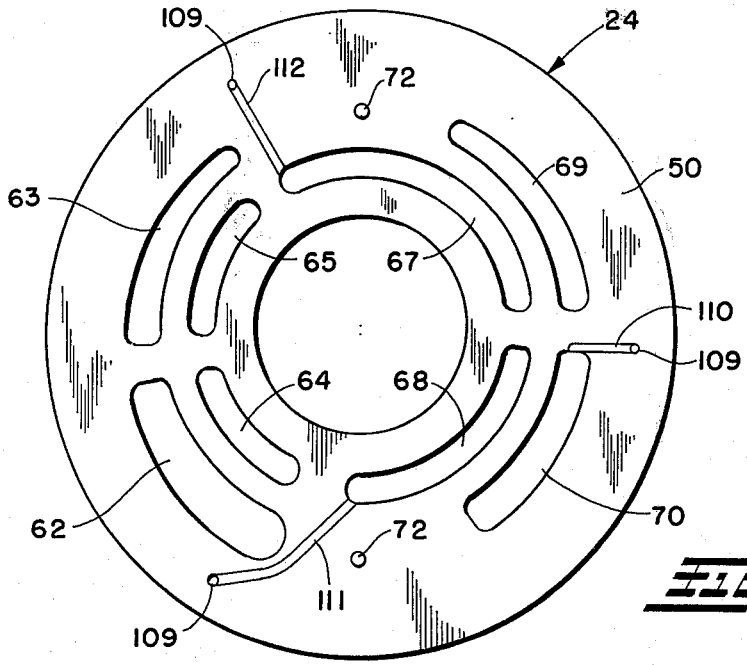
FIG. 8 is a view of the side of the rigid plate that is away from the rotor and cam ring and against a wall of the housing.

As illustrated in FIGS. 6, 7 and 8, stationary plate 24 on its side 52 that fits next to the rotor 21 and cam ring 26 has three arcuate hydrostatic grooves 100 and adjacent thereto has lands 101 and 102 and also has a circular groove 104 with adjacent lands 105 and 106. Shallow restricted grooves 108 connect each of the hydrostatic grooves 100 with an opening 109 through the plate and restricted groove 107 connects groove 104 with opening 68. Radial slots 103 connect an annular groove 115 to the periphery of the plate 24. On the other side 50 of the plate, one of the holes 109 is connected by a groove 110 with high pressure opening 70, another hole 109 connects to opening 67 by groove 112, and another hole 109 is connected by a groove 111 with high pressure opening 68.

Figure 9:
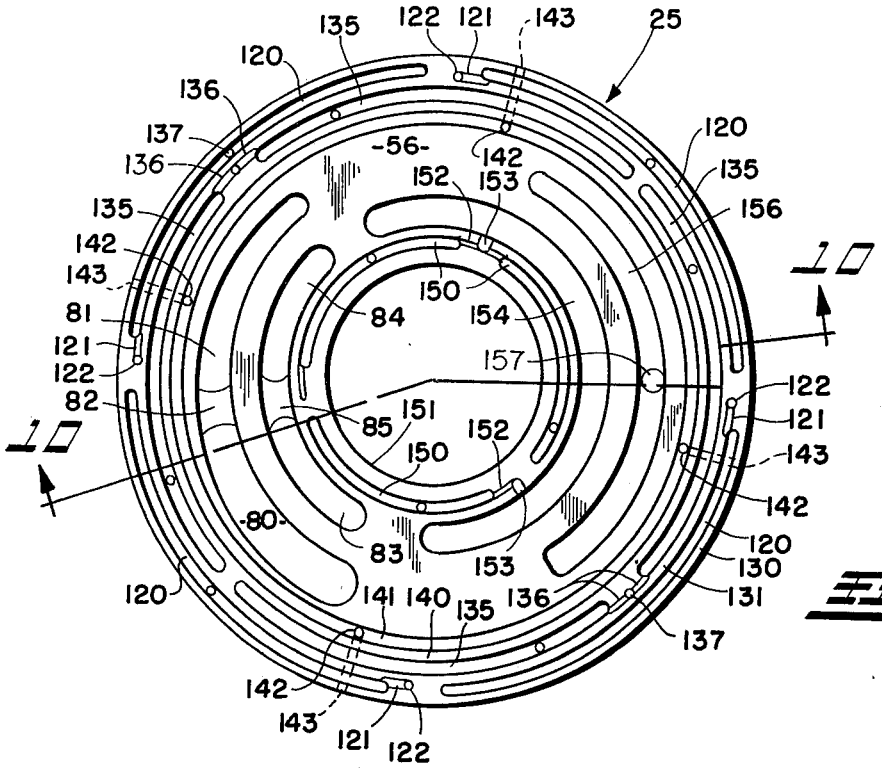
FIG. 9 is a view of the side of the floating plate that fits against the rotor and cam ring.
Figure 10:
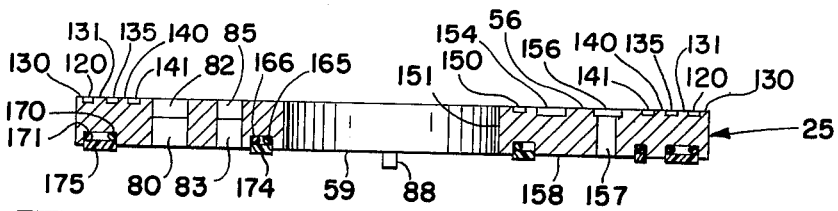
FIG. 10 is a view along lines 10—10 of FIG. 9.
Figure 11:
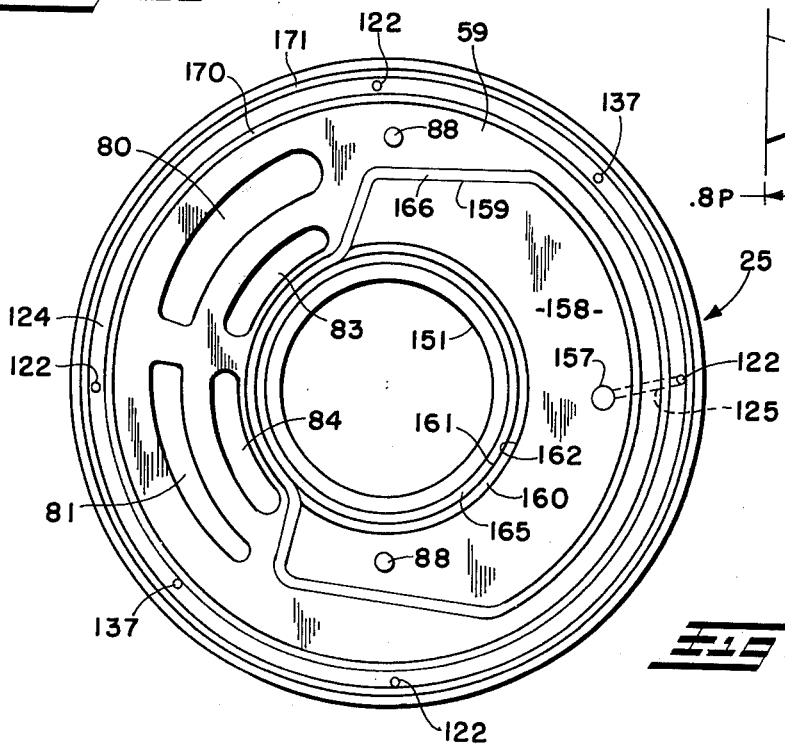
FIG. 11 is a view of the other side of the floating side plate.

Floating plate 25, as shown in FIGS. 9, 10 and 11 has a radially outer series of arcuate hydrostatic grooves 120 each connected by a respective restricted groove 121 with a respective opening 122 that passes through the plate 25 to register with an annular groove 124 on the opposite side of the plate 25. A passage 125 connects one of the openings 122 to pressure opening 157. Radially outwardly and inwardly of grooves 120 are annular lands 130 and 131. Inwardly of land 131 is an additional grouping of hydrostatic grooves 135 which are connected by respective restricted grooves 136 with openings 137 that also pass through the plate 25 and connect with groove 124. Inwardly of the grooves 135 is another annular land 140 and inwardly of the latter is an annular groove 141 that is connected to the periphery of the plate by passages 142 and 143.

Another set of hydrostatic grooves 150 is near central opening 151 of plate 25 and each is connected by a respective restricted groove 152 with another groove 153 that connects with an arcuate high pressure channel 154. Outwardly of channel 154 is another arcuate channel 156 which is connected by the opening 157 with a high pressure face 158 on the opposite side of the plate 25, and which is defined by a channel 159 and a portion of an annular groove 160 having radially inner and outer walls 161 and 162. Mounted within annular groove 160 against the inner wall 161 thereof is an O packing ring 165 and mounted within channel 159 and a left hand portion of groove 160, as viewed in FIG. 11, is another packing ring 166, preferably of circular cross-section. Mounted along the inner and outer walls of annular groove 124 are O-rings 170 and 171. As shown in FIG. 5, there is a plastic pad or backup member 174 that sealingly bears against housing wall 57 and partially enters annular groove 160 and channel 159 to seal against packing rings 165 and 166. There is also a plastic pad or backup member 175 sealingly against housing face 57 and partially entering annular groove 124 to seal against packing rings 170 and 171 located therein. The hydrostatic grooves heretofore described in plates 24, 25 provide a means whereby a predetermined clearance C (see FIG. 5) will be maintained between the side plates 24, 25 and rotor 21 and cam ring 26 regardless of manufacturing variations, part distortions, part wear and differential expansion of the pump parts due to thermal differentials within the pump during operation, as will now be described.

FIG. 5 shows the plates 24, 25 with a predetermined clearance C with the rotor 21 and cam ring 26 greatly exaggerated. When the pump is operating, fluid at outlet pressure from pressure cavity 91 enters grooves 154 and 156. From groove 156 the pressure fluid passes through opening 157 to act on the pressure face 158 bounded by packing rings 165, 166 (See FIG. 11). This pressure loads plate 25 toward the rotor 21 and cam ring 26 to counterbalance the pressure in high pressure chamber 91 tending to move plate 25 away from the rotor but only that part of the pressure within groove 160 takes part in maintaining clearance C constant during temperature changes within the pump.

Passage 125 (FIG. 11) connects groove 124 to pump pressure in opening 157 and pressure in this groove pushes the radially outer portion of plate 25 toward cam ring 26. Fluid in groove 124 at full pump pressure passes through openings 122 and 137. From openings 122 the fluid passes through the restricted passages 121 which are sized to drop the pressure of fluid flowing therethrough from openings 122 to hydrostatic grooves 120 so that the pressure in grooves 120 will be about 80% of full pump pressure. Likewise, fluid at full pump pressure passing through openings 137 from groove 124 will enter restricted passageways 136 and flow into hydrostatic grooves 135, again at a pressure of about 80% that of full pump pressure. Fluid from hydrostatic grooves 120, 135 will flow across lands 130 and 140 to the periphery of the plate and to groove 141 respectively. From groove 141, the fluid makes its way through openings 142 and passages 143 to the periphery of the plate. From this latter fluid is returned to a reservoir through a drain port 146. (FIG. 1)

Restrictions 121 and 136 have a depth of about 0.003 inch and the flow therethrough is laminar so that the equation indicated above applies. The length and width of these restrictions are further so designed that under a specific condition of pump pressure, such as 2,500 psi, and a desired 2,000 psi pressure in the hydrostatic grooves, the flow through these restrictions of a fluid with a viscosity of 43.2 centistokes will be 0.016 gallons per minute. The adjacent lands 130 and 140 may have a width of 0.100 inch and an effective length of 4.375 inch. Under these conditions fluid flowing across the lands 130 and 140 from hydrostatic grooves 120 and 135 will establish a clearance (or oil film thickness) with the cam ring 26 of 0.00036 inch. By reference to the above formula it will be seen that this clearance will then be maintained substantially constant despite differential expansion of the parts due to temperature differentials and also under changes of pressure and viscosity of the fluid. To accommodate expansion of the rotor 21 due to temperature increase, plate 25 can move slightly toward and away from housing wall 57 without losing the seal established by packings 165, 166, 170 and 171.

Figure 12:
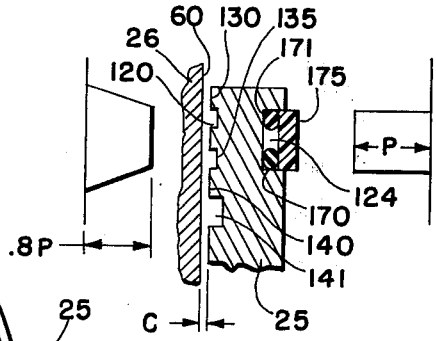
FIG. 12 is a diagrammatic representation of the hydrostatic forces which are effective to maintain a predetermined clearance between the cam ring and adjacent flexible side plate.

Referring now to the pressure-area diagrams of FIG. 12, if the clearance C increases above 0.00036 inch due, for example, to thermal expansion of the rotor 21 width, the increased flow through the restrictions 121, 136 and across the lands 130 and 140 accompanied by drop in pressure in the hydrostatic grooves 120, 135 to less than 80% P, the plate 25 will be flexed toward the cam ring by the pressure P in groove 124 to re-establish the desired clearance C (or oil film thickness) of 0.00036 inch. On the other hand, if for some reason the clearance C decreases to less than 0.00036 inch, the decreased flow through the restrictions 121, 136 and across the lands 130 and 140 accompanied by increase in pressure in the hydrostatic grooves 120, 135 to a value greater than 80% P the plate 25 will be moved away from or flexed away from the cam ring 26 to re-establish the desired clearance C of 0.00036 inch.

Meanwhile, pressure fluid in groove 160 pushes the inner margin of plate 25 toward the side face of rotor 21. Also, pressure fluid within groove 154 enters slots 153 and passes through restricted passages 152 to enter hydrostatic bearing grooves 150 that are adjacent the rotor face. The restrictions 152 are also so proportioned that the pressure of fluid in hydrostatic grooves 150 is about 80% of pump pressure and the lands adjacent these grooves 150 are proportioned so that leakage fluid passing between these lands and the rotor 21 will establish a clearance with the rotor 21 substantially the same as the clearance between the plate 25 and the cam ring 26.

An important feature of the invention is that even though plate 25 is relatively thick, it is still flexible so that under the pressure conditions encountered, the inner margin that is opposite the rotor surface 61 may flex relative to the outer margin that is opposite the cam ring 26 so that the proper clearances at these two locations wll be maintained even though the thicknesses of the cam ring 26 and rotor 21 are not precisely the same whereby their side faces 60 and 61 are not in exactly the same plane. Also, the hydrostatic grooves 150 are arcuately segmented so that the plate may flex slightly between such segments to accommodate slight imperfections in the flatness of either the plate 25 or the cam ring or rotor surfaces 60 and 61.

Side plate 24 is not provided with pressure loading surfaces corresponding to grooves 124 and 160 in plate 25 and finds a stationary position against cap wall 51. However, its hydrostatic grooves 100 via restricted passages 108 and lands 101 and 102 establish a predetermined clearance with cam ring 26 and its hydrostatic groove 104 via restricted passage 107 and lands 105 and 106 establish predetermined clearances between such lands and cam ring 26 and rotor 21 in the manner described in connection with plate 25. In this instance, the hydraulic loading to balance the loading in these hydrostatic grooves is furnished by the fluid pressure in cavities 124 and 160 acting through plate 25, hydrostatic grooves 120, 135 and 150 in plate 25, through cam ring 26 and rotor 21.

With further reference to FIGS. 1 and 5, it will be apparent that the plate 24 may be replaced by another floating and flexible plate 25 to accommodate tilting of the rotor 21 due to wear of the bearings 17 and 18, for example. Furthermore, although the present invention as herein illustrated and described is a variable displacement vane pump 10, it is to be understood that the features of this invention may be applied to fixed displacement vane pumps in which the cam ring 26 will be fixed and the hydrostatic bearings are only required between the plate 25 and the side face 61 of the rotor 21 to maintain the desired clearance C as by flexing of the inner marginal portion of the plate 25.

The embodiments of the invention in which an exclusive property or privilege is claimed are defined as follows:

1. In a vane pump having a housing with a pumping chamber intersected by inlet and outlet ports and a rotor in the chamber for conducting fluid from the inlet to the outlet when rotated and for pressurizing the fluid so conducted to the outlet, and a side plate between a side of the rotor and a wall of the housing, the improvement that comprises means providing a pressure area on the side of the plate next to said wall, passage means for conducting a portion of said pressurized fluid to said area for pressure biasing the plate toward said rotor, a groove in said plate on the side next to said rotor, means including a restricted passage for conducting a portion of said pressurized fluid to said groove, said plate having a bearing surface adjacent said groove and in close proximity to said side of said rotor, and passage means leading from a portion of said bearing surface remote from said groove to a low pressure zone within the pump whereby fluid entering said groove through said restricted passage will leave said groove between said bearing surface and said rotor and will permit the plate to move toward or away from said rotor to establish a predetermined clearance between said bearing surface and rotor when the fluid pressure forces acting on both sides of the plate on said area and on said groove and bearing surface are balanced; said restricted passage having a flow capacity and consequent pressure drop effective to vary the fluid pressure in said groove upon variance of said predetermined clearance to thereby unbalance said fluid pressure forces for moving said plate toward or away from said rotor owing to flow of fluid from said groove being greater than or less than the flow of fluid through said predetermined clearance.

2. The pump of claim 1 in which said groove is substantially opposite said area.

3. In a vane pump having a housing with a pumping chamber intersected by inlet and outlet ports and a rotor in the chamber for conducting fluid from the inlet to the outlet when rotated and for pressurizing the fluid so conducted to the outlet, a cam ring surrounding the rotor and movable relative thereto for varying the output of the pump, a side plate having a first face next to a wall of the chamber and having a second face extending along a side face of the rotor and a side face of the cam ring, the improvement comprising means defining a first pressure area on a first portion of said first face for pressure biasing said first portion toward said rotor, means defining a second pressure area on a second portion of said first face for biasing said second portion toward said cam ring, means for conducting pressurized fluid to said first and second areas, a first groove in said second face generally opposite said first area, a second groove in said second face generally opposite said second area, means including restricted passages for conducting other portions of said pressurized fluid to said first and second grooves, said second face having bearing surfaces thereon adjacent said first and second grooves and in close proximity to said side faces of said rotor and cam ring, and passage means for conducting fluid from portions of said bearing surfaces remote from said grooves to a low pressure zone within the pump whereby fluid entering said grooves through said restricted passages will leave said grooves between said surfaces and said rotor and cam side faces and will establish a predetermined clearance therewith substantially in accordance with the difference in pressures within said pressure areas and the respective grooves; said restricted passages having flow capacities and consequent pressure drops effective to vary the fluid pressures in the respective first and second grooves upon variance of said predetermined clearance for moving said plate toward or away from said rotor and cam ring owing to flow of fluid from the respective grooves being greater than or less than the flow of fluid through said predetermined clearance.

4. The pump of claim 3 in which said plate is flexible between said portions thereof whereby the plate will flex to establish said predetermined clearances irrespective of the positions of said rotor and cam ring side faces.

5. In a vane pump of the type wherein a housing has inlet and outlet ports communicating with a pumping chamber therein which includes side walls and a peripheral wall embracing a vaned rotor which is rotatable in said chamber to form therewith low and high pressure zones for pumping fluid from said inlet port to said outlet port; and wherein a cam ring defines such peripheral wall and has opposite ends substantially co-planar with the ends of said rotor, the improvement which comprises a side plate between one end of said rotor and cam ring and an end wall of said housing; one side of said side plate defining one side wall of said chamber; said side plate being movable in said housing toward and away from said one end of said rotor and cam ring to maintain a predetermined clearance between said one side thereof and said one end of said cam ring; said side plate having a first area on the other side thereof which is exposed to fluid pressure in said high pressure zone exerting a force on said side plate tending to move it to decrease said clearance and having a second area on said one side exposed to high fluid pressure of lesser magnitude via restricted passages respectively from said high pressure zone to said second area and from said second area to said low pressure zone exerting a force on said side plate tending to move it to increase said clearance; said last-mentioned restricted passage comprising said clearance; said opposing forces being substantially balanced when said clearance is of predetermined magnitude; said first-mentioned restricted passage from said high pressure zone to said second area having a flow capacity and consequent pressure drop to vary the fluid pressure in said second area upon variance of said predetermined clearance to thereby unbalance said opposing forces for moving said plate toward or away from said cam ring owing to flow of fluid through said last-mentioned restricted passage from said second area to said low pressure zone being greater than or less than the flow of fluid through said predetermined clearance.

6. The vane pump of claim 5 wherein said side plate has other areas on opposite sides thereof which are substantially coextensive with said high pressure zone at said one end of said rotor and which are exposed to fluid pressure in said high pressure zone whereby maintenance of such predetermined clearances is under the control of the relative fluid pressures acting on said first and second areas.

7. The vane pump of claim 5 wherein said last-mentioned restricted passage comprises the clearances between said side plate and said cam ring and rotor; wherein said first area has radially outer and inner portions respectively opposite said cam ring and said rotor; and wherein said second area has radially outer and inner portions respectively adjacent to said one end of said cam ring and rotor; said restricted passage from said high pressure zone to said second area comprising separate restricted passages leading from said high pressure zone to the respective portions of said second area.

8. The vane pump of claim 7 wherein said side plate is flexible to maintain such predetermined clearances in the event that the ends of said cam ring and rotor do not lie in the same plane.

9. The vane pump of claim 7 wherein said side plate has a central bore therethrough; wherein said radially inner portions of said first and second areas comprise grooves concentric with said bore leaving lands between said bore and grooves which on said one side define said clearance with said one end of said rotor and which on said other side are isolated from high pressure in the adjacent groove by resilient packing ring means engaged with said end wall of said housing; and wherein said radially outer portions of said first and second areas comprise grooves concentric with said bore and inwardly spaced from the periphery of said side plate to leave lands which on said one side define said clearance with said one end of said cam ring and which on said other side are isolated from high pressure in the adjacent groove by resilient packing ring means engaged with said end wall of said housing; said resilient packing ring means being in sealed engagement with said end wall of said housing during movement of said side plate toward and away from said one end of said rotor and cam ring.

10. The vane pump of claim 9 wherein said side plate is flexible to establish and maintain such predetermined clearances despite departure of said one end of said rotor and said one end of said cam ring from co-planar relation.

11. The vane pump of claim 9 wherein said one side of said side plate has a circular groove concentrically within said groove which constitutes the radially outer portion of said second area to leave another clearance land; said circular groove being communicated with said low pressure zone.

12. In a vane pump of the type wherein a housing has inlet and outlet ports communicating with a pumping chamber therein which includes side walls and a peripheral wall embracing a vaned rotor which is rotatable in said chamber to form therewith low and high pressure zones for pumping fluid from said inlet port to said outlet port, the improvement which comprises a side plate between one end of said rotor and an end wall of said housing; one side of said side plate defining one side wall of said chamber; said side plate being movable in said housing toward and away from said one end of said rotor to maintain a predetermined clearance between said one side thereof and said one end of said rotor; said side plate having a first area on the other side thereof which is exposed to fluid pressure in said high pressure zone exerting a force on said side plate tending to move it to decrease said clearance and having a second area on said one side exposed to high fluid pressure of a lesser magnitude via restricted passages respectively from said high pressure zone to said second area and from said second area to said low pressure zone exerting a force on said side plate tending to move it to increase said clearance; said last-mentioned restricted passage being said clearance; said opposing forces being substantially balanced when said clearance is of predetermined magnitude; said first-mentioned restricted passage from said high pressure zone to said second area having a flow capacity and consequent pressure drop effective to vary the fluid pressure in said second area upon variance of said predetermined clearance to thereby unbalance said opposing forces for moving said plate toward or away from said rotor owing to flow of fluid through said last-mentioned restricted passage from said second area to said low pressure zone being greater than or less than the flow of fluid through said predetermined clearance.

13. The vane pump of claim 12 wherein another side plate is disposed between the other end of said rotor and another end wall of said housing and defines the other side wall of said chamber; said another side plate and other end of said rotor defining a pressure area exposed to fluid pressure in said high pressure zone to maintain a predetermined clearance between said another side plate and said other end of said rotor.

14. The vane pump of claim 12 wherein said first and second areas are substantially annular; and wherein said last-mentioned restricted passage is substantially annular.

15. The vane pump of claim 12 wherein said side plate has other areas on opposite sides thereof which are substantially coextensive with said high pressure zone at said one end of said rotor and which are exposed to fluid pressure in said high pressure zone whereby maintenance of such predetermined clearance is under the control of the relative fluid pressures acting on said first and second areas.

16. The vane pump of claim 15 wherein sealing means between said other side of said side plate and said end wall of said housing define said first and other areas on said other side of said side plate during movement of said side plate toward and away from said one end of said rotor.

17. The vane pump of claim 12 wherein said side plate has a central bore therethrough; and wherein said first and second areas comprise grooves concentric with said bore leaving lands between said bore and groove which on said one side define said clearance with said one end of said rotor and which on said other side are isolated from high pressure in the adjacent groove by resilient packing ring means engaged with said end wall of said housing during movement of said side plate toward and away from said one end of said rotor.

18. The vane pump of claim 17 wherein said groove on said one side comprises a plurality of arcuate grooves having restricted communication with a surrounding arcuate groove which is exposed to said high pressure zone.

19. The vane pump of claim 12 wherein said pump has a cam ring defining such peripheral wall of said chamber; and wherein said side plate extends radially to overlie one end of said cam ring to maintain a predetermined clearance between said one side of said side plate and said one end of said cam ring; said side plate having other first and second areas on opposite sides thereof and other restricted passages to establish and maintain a predetermined clearance between said one side of said side plate and said one end of said cam ring.

20. The vane pump of claim 19 wherein said side plate is flexible to establish and maintain such predetermined clearances despite departure of said one end of said rotor and said one end of said cam ring from co-planar relation.

21. The vane pump of claim 19 wherein sealing means between said other side of said side plate and said end wall of said housing define said first, other first, and other areas on said other side of said side during movement of said side plate toward and away from said one end of said rotor and cam ring.

22. The vane pump of claim 19 wherein said first and second areas and said other first and second areas are substantially annular; and wherein said last-mentioned restricted passage comprises substantially annular clearances between said one side of said side plate and said one end of said rotor and cam ring.

23. The vane pump of claim 22 wherein sealing means between said other side of said side plate and said end wall of said housing define said first and other first areas during movement of said side plate toward and away from said one end of said rotor and cam ring.

24. The vane pump of claim 22 wherein said side plate is flexible to maintain such clearances despite departure of said one end of said rotor and cam ring from co-planar relation.

* * * * *